US006501923B2

(12) United States Patent
Aoki et al.

(10) Patent No.: US 6,501,923 B2
(45) Date of Patent: Dec. 31, 2002

(54) IMAGE FORMING APPARATUS WITH INCREASED HEAT DISSIPATION STRUCTURE

(75) Inventors: Shinji Aoki, Yokohama (JP); Takao Izumi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/863,396

(22) Filed: May 24, 2001

(65) Prior Publication Data

US 2002/0176721 A1 Nov. 28, 2002

(51) Int. Cl.[7] ..... G03G 15/00; G03G 15/08; G03G 21/20

(52) U.S. Cl. ..... 399/96; 399/162; 399/284; 399/286

(58) Field of Search ..... 399/92, 96, 159, 399/162, 228, 279, 284, 286

(56) References Cited

U.S. PATENT DOCUMENTS 5,132,733 A * 7/1992 Koizumi et al. ..... 399/228
5,592,266 A * 1/1997 Park et al. ..... 399/284
5,689,766 A * 11/1997 Hollar et al. ..... 399/92
5,689,767 A * 11/1997 Domoto et al. ..... 399/96 X
6,026,266 A * 2/2000 Sakai et al. ..... 399/284 X
6,078,769 A * 6/2000 Fraser et al. ..... 399/279
6,163,669 A * 12/2000 Aoki et al. ..... 399/159

* cited by examiner

*Primary Examiner*—William J. Royer
(74) *Attorney, Agent, or Firm*—Foley & Lardner

(57) ABSTRACT

An image forming apparatus according to the invention includes a photosensitive belt for carrying an electrostatic latent image, a developing roller to be brought into contact with the photosensitive belt for supplying a non-magnetic mono-component developer to the electrostatic latent image carried by the photosensitive belt, thereby forming a developer image, a thickness-limiting blade kept in contact with the developing roller for limiting, to a predetermined value, the thickness of the developer provided on the developing roller, and a transfer unit for transferring the developer image, carried by the photosensitive belt, onto a sheet of paper, wherein the photosensitive belt, the developing roller and the thickness-limiting blade are each made of a metal.

6 Claims, 6 Drawing Sheets

IMAGE FORMING APPARATUS WITH INCREASED HEAT DISSIPATION STRUCTURE

BACKGROUND OF THE INVENTION

The present invention relates to an image forming apparatus, such as a copy machine or a printer, which uses electrophotography.

As an image forming apparatus of this type, there is an apparatus for forming an electrostatic latent image on a photosensitive drum, and supplying the latent image with a non-magnetic mono-component developer to develop it, using a developing roller. The developing roller abuts against a layer-thickness-limiting member. This member enables the formation, on the developing roller, of a layer of the non-magnetic mono-component developer having a predetermined thickness. The photosensitive drum comprises, for example, an aluminum tube and a photosensitive layer provided on the outer periphery of the tube.

In order to develop an electrostatic latent image in a good condition, it is necessary to secure a sufficient nipping force at a contact portion between the photosensitive drum and the developing roller.

To this end, in the prior art, the base material of the photosensitive drum is formed of an aluminum tube, the developing roller is formed of an elastic rubber member, and the layer-thickness-limiting member is formed of a layer-thickness-limiting metal blade having elasticity.

However, in providing a sufficient nipping force at the nipping portion between the developing roller and the layer-thickness-limiting blade where the developing roller is formed of an elastic rubber member, frictional heat created at the nipping portion inevitably accumulates in the elastic developing roller. As a result, the developer may adhere to the layer-thickness-limiting blade and/or the developing roller, thereby disrupting development.

On the other hand, there is a conventional image forming apparatus using electrophotography, which employs a metal developing roller and a photosensitive belt formed of a high polymer film such as polyester (PET), as a base material. Further, the layer-thickness-limiting blade is formed of a plate spring or a plate spring coated with, for example, urethane resin chips. The developing roller employed in this conventional case is made of a metal and therefore has a high thermal conductivity and dissipation quality.

In this case, however, the base material of the photosensitive belt is polyester (PET), and therefore the photosensitive belt has a low thermal conductivity and dissipation quality. This being so, frictional heat created at the contact portion between the layer-thickness-limiting blade and the developing roller accumulates in the developing roller, with the result that the developer may adhere to the layer-thickness-limiting blade and/or the developing roller, thereby disrupting development.

BRIEF SUMMARY OF THE INVENTION

The present invention has been developed in light of the above-described circumstances. In the image forming apparatus of the invention, a developing roller, a thickness-limiting blade and a base material of a photosensitive belt are each made of a metal, and thus the frictional heat generated at the contact portion between the developing roller and the thickness-limiting blade is effectively transmitted to the photosensitive belt to be dissipated.

Accordingly, an increase in the temperature of each developing unit can be prevented, thereby preventing the adhesion of toner to the developing roller and/or the thickness-limiting blade, and hence enabling good development.

Further, when using a thickness-limiting metal roller as the thickness-limiting member, a higher temperature increase suppressing effect can be obtained, since the heat dissipation area of the roller is larger than that of a blade-type thickness-limiting member.

Also, since the developing roller of each developing unit is brought into contact with the photosensitive belt after the image forming process, the effect of dissipating the heat of each developing unit can be enhanced.

In addition, since a cooling fan cools the photosensitive belt, an increase in the temperature of each developing unit can be more reliably suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
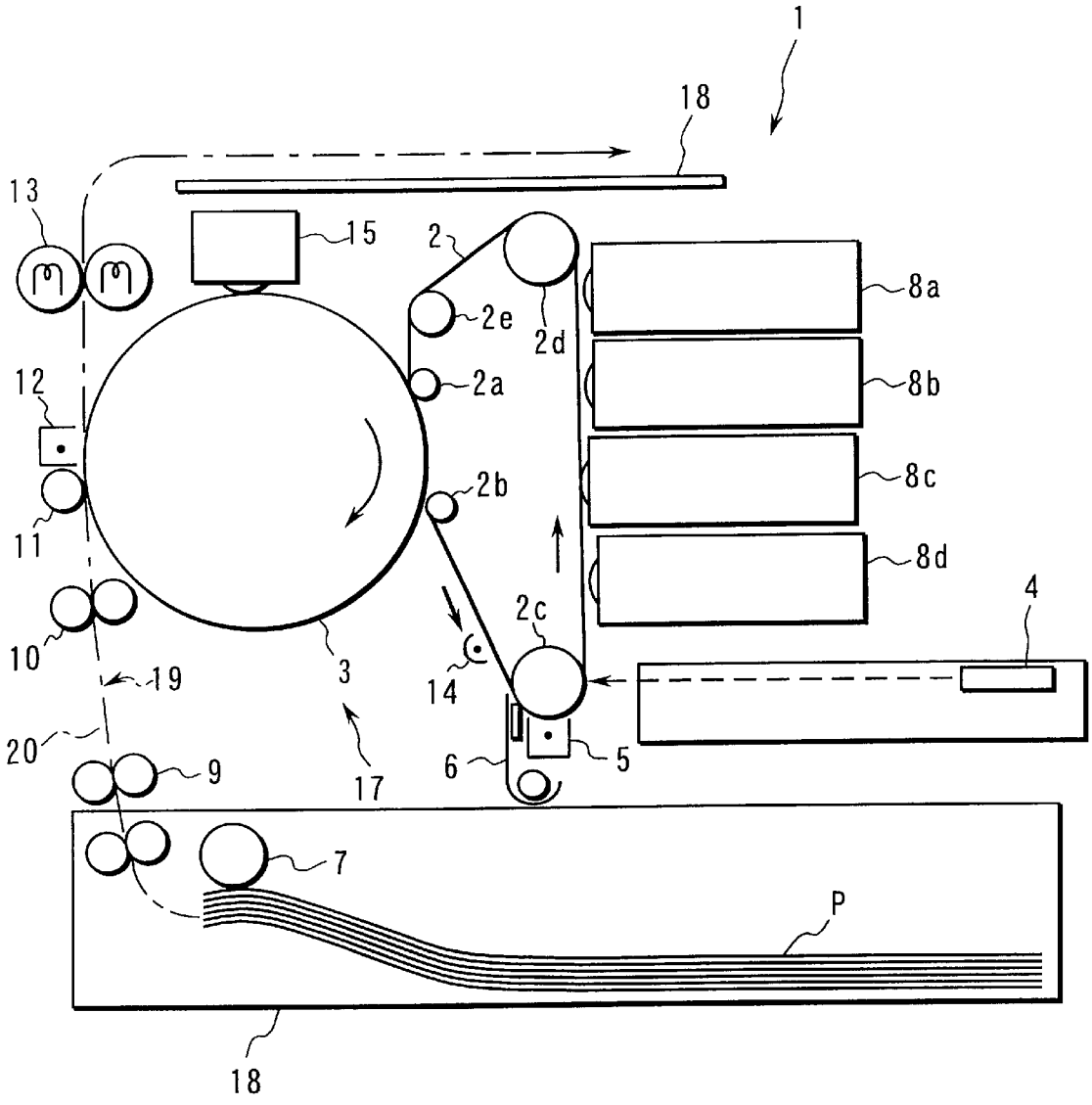
FIG. 1 is a view illustrating an electrophotographic copy machine according to a first embodiment of the invention.

FIG. 1 shows an image forming apparatus 1 using an electrophotographic process according to a first embodiment of the invention.

The image forming apparatus 1 has a photosensitive belt 2 as an image carrier belt. The photosensitive belt 2 is tensioned between first through fifth rollers 2*a*–2*e* such that it can rotate in a direction indicated by the arrows. A charger unit 5, an exposure unit 4, first through fourth developing units 8*a*–8*d*, an intermediate transfer unit 3 and a cleaning unit 6 are provided in this order along the photosensitive belt 2 in the direction of its rotation. Further, a peeling unit 12 and a cleaner 15 are provided around the intermediate transfer unit 3, thereby constructing an image forming section 17.

The first developing unit 8*a* supplies yellow toner, the second developing unit 8*b* magenta toner, the third developing unit 8*c* cyan toner, and the fourth developing unit 8*d* black toner.

The charger unit 5 charges the photosensitive belt 2 with a predetermined potential, while the exposure unit 4 forms an electrostatic latent image on the photosensitive belt 2. The first through fourth developing units 8*a*–8*d* supply the respective toners onto the electrostatic latent image on the photosensitive belt 2, thereby forming a toner image. The intermediate transfer unit 3 temporarily holds the toner image formed on the photosensitive belt 2. The cleaning unit 6 removes toner remaining on the photosensitive belt 2. The cleaner 15 cleans the intermediate transfer unit 3, and the peeling unit 12 peels a paper sheet (described later) from the intermediate transfer unit 3.

The photosensitive belt 2 tensioned between the first through fifth rollers 2*a*–2*e* has a predetermined tension. That portion of the photosensitive belt 2, which is positioned between the first and second rollers 2*a* and 2*b*, is in tight contact with the outer periphery of the intermediate transfer unit 3. That portion of the photosensitive belt 2, which is positioned between the third and fourth rollers 2*c* and 2*d*, is at a predetermined distance from the first through fourth developing units 8*a*–8*d*.

While one of the first through fifth rollers 2*a*–2*e* is being rotated by a drive motor (not shown), the photosensitive belt 2 is rotated at a predetermined speed in the direction indicated by the arrows.

A paper cassette 18 containing paper sheets P of a predetermined size is located below the image forming section 17. A paper feed roller 7 is provided in the paper cassette 18 for picking up the paper sheets P one by one. Each paper sheet P picked up by the paper feed roller 7 is upwardly conveyed by conveyance means 19 along a conveyance path 20. Conveyance rollers 9, aligning rollers 10, a transfer roller 11, the peeling unit 12 and a fixing unit 13 are provided in this order along the conveyance path 20 in the direction of paper conveyance.

The aligning rollers 10 temporarily stop each paper sheet P conveyed by the conveyance means 19 so as to eliminate possible disinclination of each paper sheet P with respect to the conveyance direction, and also to make the front end of each paper sheet P correspond to that of a toner image on the intermediate transfer unit 3.

The peeling unit 12 is provided to supply an AC charge to each paper sheet P having a toner image transferred thereto, and to peel it from the intermediate transfer unit 3. The fixing unit 13 fixes the transferred toner image on each paper sheet P. A paper discharge tray 18 is provided above the intermediate transfer unit 3 for receiving the paper sheets discharged from the fixing unit 13.

A description will now be given of a full-color printing operation executed by the image forming apparatus.

First, the photosensitive belt 2 is rotated, thereby causing the charger unit 5 to charge the surface of the photosensitive belt 2 with a predetermined potential. After this charging process, the exposure unit 4 exposes the surface of the photosensitive belt 2 so as to form thereon an electrostatic latent image corresponding to a yellow image. This electrostatic latent image is supplied to the yellow developing unit 8*a* in accordance with the rotation of the photosensitive belt 2, where it is developed with yellow toner supplied from the yellow developing unit 8*a*. The developed toner image is fed to and transferred onto the intermediate transfer unit 3. After the toner image is transferred, a deelectrifying unit 14 deelectrifies the photosensitive belt 2 separated from the intermediate transfer unit 3, and the cleaning unit 6 removes the toner that was not transferred to the intermediate transfer unit 3 and remains on the photosensitive belt 2. The removed toner is collected into a used-toner box.

After that, the charger unit 5 again charges the photosensitive belt 2, and the exposure unit 4 exposes it so as to form thereon an electrostatic latent image corresponding to a magenta image. This electrostatic latent image is supplied to the magenta developing unit 8*b* in accordance with the rotation of the photosensitive belt 2, where it is developed with magenta toner supplied from the magenta developing unit 8*b*. The developed toner image is transferred onto the yellow toner image previously transferred to the intermediate transfer unit 3. Concerning a cyan image and a black image, a similar process is executed, whereby four color toner images are superposed upon each other on the intermediate transfer unit 3. After that, a paper sheet P is fed between the intermediate transfer unit 3 and the transfer roller 11, thereby simultaneously transferring the superposed four color toner images onto the paper sheet P.

The paper sheet P with the four color toner images transferred thereon is peeled from the intermediate transfer unit 3 by the peeling unit 12. The peeled paper sheet P is conveyed to the fixing unit 13, where the toner images are fixed on the paper sheet P to thereby form a color image. The paper sheet P with the color image is discharged to the discharge tray 18.

On the other hand, the toner, which was not transferred to the paper sheet P, remains on the intermediate transfer unit 3. Therefore, after the secondary transfer process, the cleaner 15 is brought into contact with the intermediate transfer unit 3 to clean it.

Until the aforementioned four color toner images are superposed into a single color image on the intermediate transfer unit 3, the intermediate transfer unit cleaner 15 is kept out of contact with the intermediate transfer unit 3.

Figure 2:
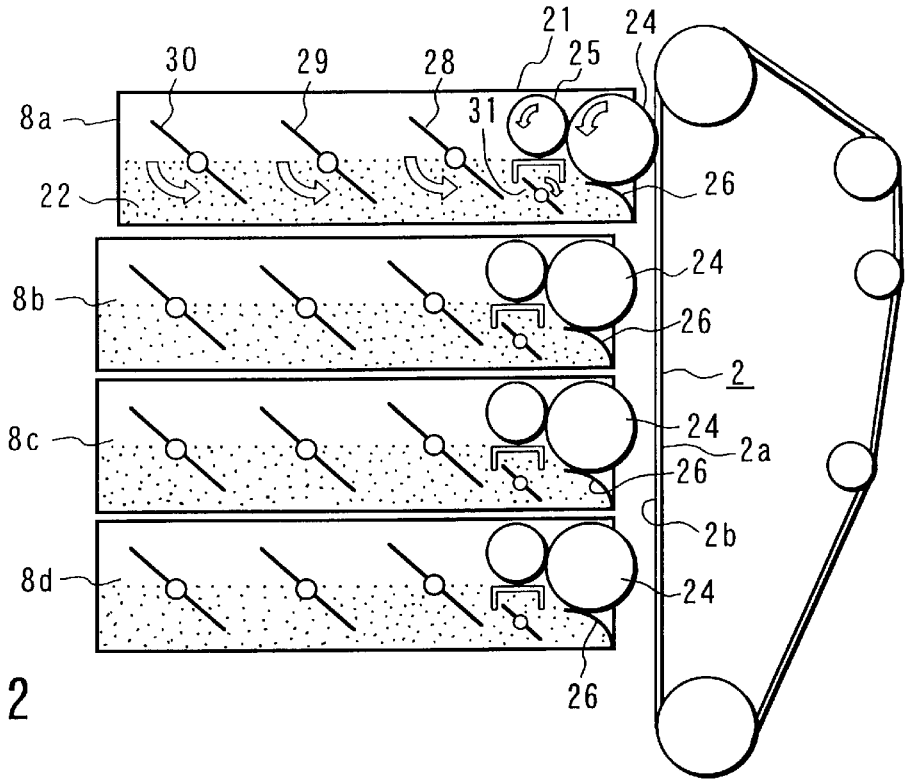
FIG. 2 is a view illustrating an image forming section.

FIG. 2 shows the first through fourth developing units 8*a*–8*d* and the photosensitive belt 2.

The developing units 8*a*–8*d* each include a casing 21 having a front opening and containing a non-magnetic mono-component toner 22 as a developer. A developing roller 24 is rotatably provided in a front-side inner portion of the casing 21, and a removing/supplying roller 25 is provided in contact with the developing roller 24. A thickness-limiting blade 26 as a thickness-limiting member is provided below the developing roller 24. The casing 21 also contains three conveyance springs 28–30 and a collecting/mixing paddle 31.

At the time of development, the developing roller 24, the removing/supplying roller 25, the conveyance springs 28–30 and the collecting/mixing paddle 31 are rotated.

Toner 22 is conveyed to the removing/supplying roller 25 in accordance with the rotation of the conveyance springs 28–30, and conveyed to and carried by the developing roller 24 in accordance with the rotation of the removing/ supplying roller 25. The toner 22 carried by the developing roller 24 is conveyed in accordance with the rotation of the same, with its thickness limited to a predetermined value by the thickness-limiting blade 26. The toner having its thickness limited is supplied onto a latent image on the photosensitive belt 2 in accordance with the rotation of the developing roller 24, thereby developing the latent image.

The developing roller 24 is made of aluminum, while the thickness-limiting blade 26 is made of stainless steel (SUS). Further, the photosensitive belt 2 is formed of a base material 2*a* and a photosensitive layer 2*b* provided thereon. The base material 2*a* is prepared by electroforming Ni.

The thickness-limiting blade 26 has a thickness of 0.1 mm and is pressed against the developing roller 24 with a force of 70 gf/cm. The photosensitive layer 2*b* of the photosensitive belt 2 has a thickness of 20 $\mu$m, and the Ni layer of the base material 2*a* has a thickness of 100 $\mu$m. The circumferential speed of the developing roller 24 is 400 mm/s, and the running speed of the photosensitive belt 2 is 180 mm/s.

Figure 3:
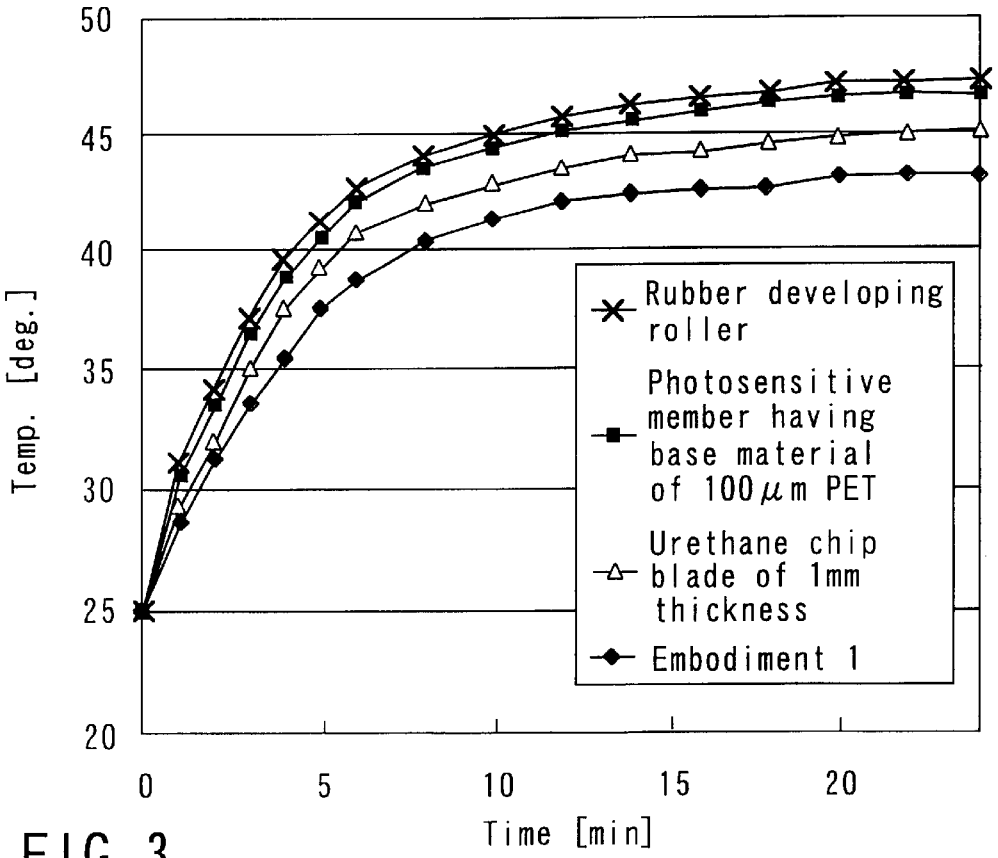
FIG. 3 is a graph useful for comparing the temperature changes in respective developing rollers employed in the embodiment and in the conventional art.

FIG. 3 shows temperature changes in the developing roller 24 during development.

FIG. 3 also shows temperature changes in the developing roller 24 assumed when each of the developing roller, the thickness-limiting blade and the base material of the photosensitive belt is made of a material other than a metal, i.e. when the developing roller is made of rubber, when the base material of the photosensitive belt is made of PET of 100 $\mu$m thickness, and when the thickness-limiting blade is made of urethane chips of 1 mm thickness.

In this embodiment, since both the developing roller 24 and the thickness-limiting blade 26 are made of a metal, they have a high thermal conductivity and dissipation quality. This means that frictional heat generated at the contact section between the developing roller 24 and the thickness-limiting blade 26 hardly accumulates in each developing unit 8*a*–8*d* and is effectively transmitted to the photosensitive belt 2.

Further, since the base material 2*a* of the photosensitive belt 2 is made of a metal and in the form of a thin layer, it has a high thermal conductivity and dissipation quality, and hence an increase in the temperature of each developing unit 8*a*–8*d* can be effectively suppressed.

The same advantage can be obtained if the developing roller 24 is made of stainless steel (SUS) or brass.

The thickness-limiting blade 26 may be made of a metal having elasticity, such as phosphor bronze.

The Ni layer formed by electroforming and used as the base material 2*a* of the photosensitive belt 2 is usually set to have a thickness of 40–150 $\mu$m.

Figure 4:
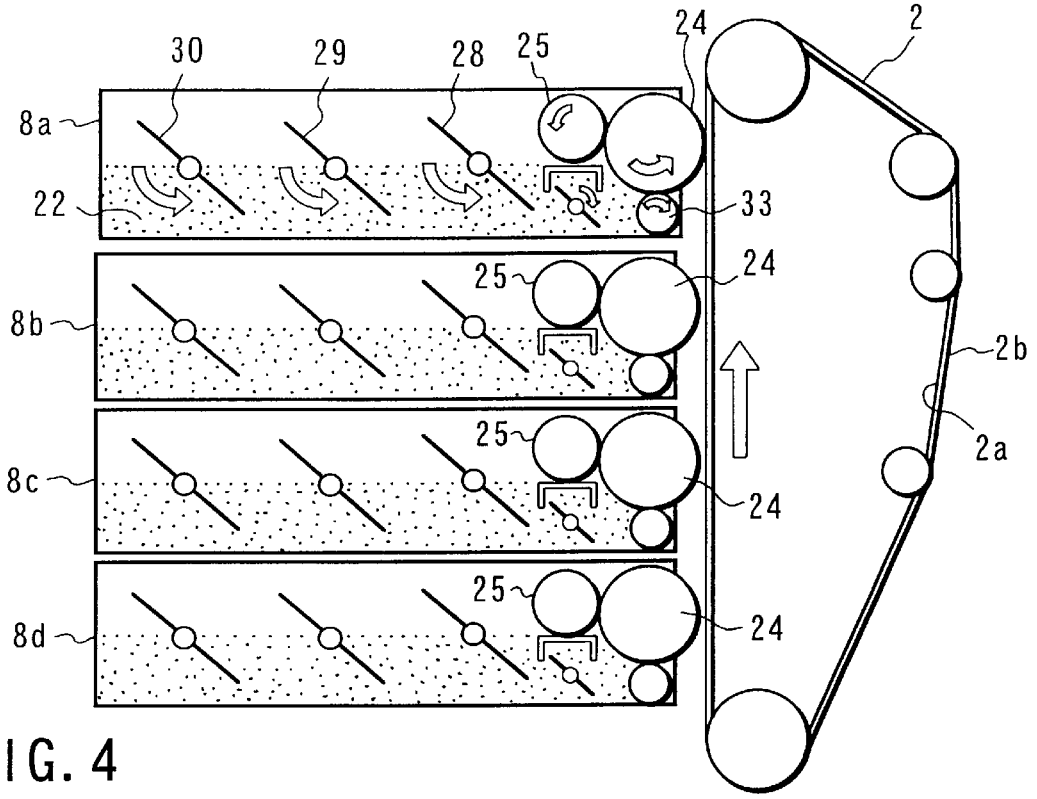
FIG. 4 is a view illustrating an image forming section incorporated in an electrophotographic copy machine according to a second embodiment of the invention.

FIG. 4 shows an image forming section according to a second embodiment of the invention.

In this embodiment, elements similar to those in the first embodiment are denoted by corresponding reference numerals and are not described.

In the second embodiment, a thickness-limiting roller 33 made of aluminum is used as the thickness-limiting member. Further, a stainless steel roller is used as the developing roller 24. The pressing force of the thickness-limiting roller 33 applied to the developing roller 24 is 70 gf/cm.

The thickness-limiting roller 33 rotates in contact with the developing roller 24 in a direction opposite to the direction of rotation of the developing roller 24. The circumferential speed ratio of the developing roller 24 to the thickness-limiting roller 33 is preferably set at 0.2 or less.

Figure 5:
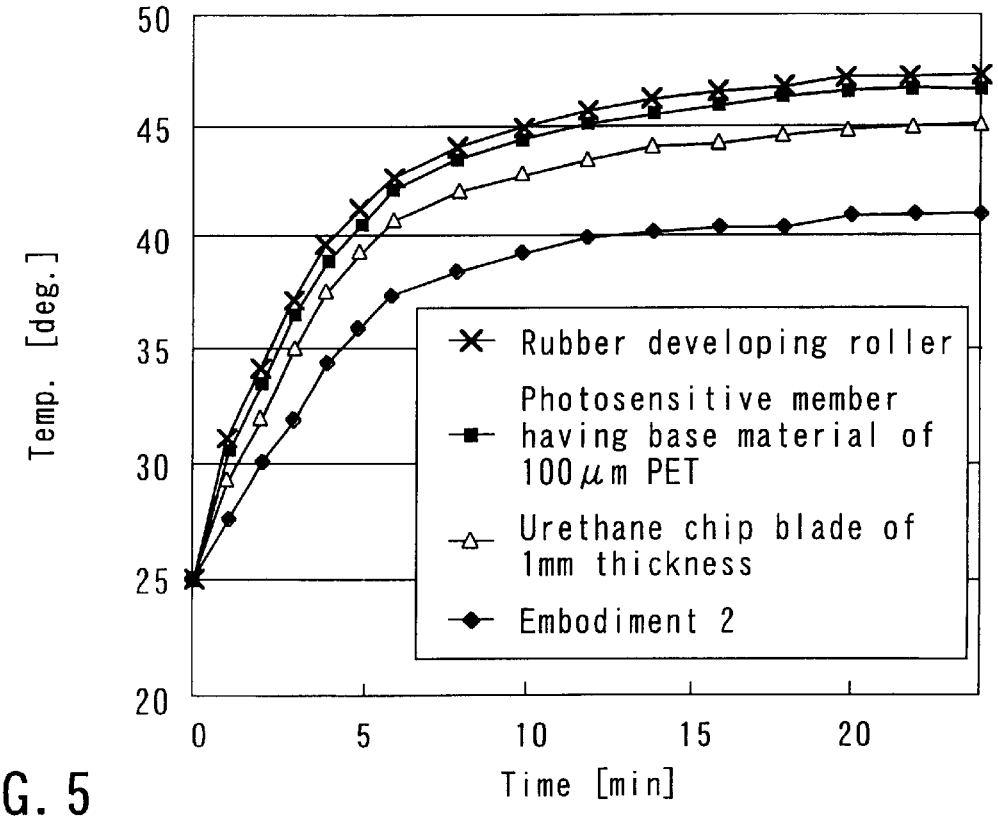
FIG. 5 is a graph useful for comparing the temperature changes in respective developing rollers employed in the embodiment and in the conventional art.

FIG. 5 illustrates temperature changes in the developing roller 24 during development.

FIG. 5 also illustrates temperature changes in the developing roller 24 assumed when each of the developing roller, a thickness-limiting blade and the base material of the photosensitive belt is made of a material other than a metal, i.e. when the developing roller is made of rubber, when the base material of the photosensitive belt is made of PET of 100 $\mu$m thickness, and when the thickness-limiting blade is made of urethane chips of 1 mm thickness.

In the second embodiment, since the photosensitive belt 2, the developing roller 24 and the thickness-limiting roller 33 are each made of a metal as in the first embodiment, they have a high thermal conductivity and dissipation quality. This means that frictional heat generated at the contact section between the developing roller 24 and the thickness-limiting blade 26 hardly accumulates in each developing unit 8*a*–8*d* and is effectively transmitted to the photosensitive belt 2.

Further, the thickness-limiting roller 33 used as the thickness-limiting member has a larger heat dissipation area than a thickness-limiting member in the form of a blade. As a result, an increase in the temperature of each developing unit 8*a*–8*d* can be more effectively suppressed.

Furthermore, the contact section between the developing roller 24 and the thickness-limiting roller 33 continuously varies during development, i.e. while the developing roller 24 and the thickness-limiting roller 33 are being rotated. Accordingly, the contact section between the developing roller 24 and the thickness-limiting roller 33 is prevented from assuming a high temperature state. Accordingly, toner adhesion hardly occurs at the contact section between the developing roller 24 and the thickness-limiting roller 33.

The thickness-limiting roller 33 may be made of stainless steel (SUS) or brass, and the developing roller 24 may also be made of stainless steel (SUS) or brass. Moreover, the thickness-limiting roller 33 may be driven by a motor dedicated thereto, instead of being driven in accordance with the rotation of the developing roller 24.

Figure 6:
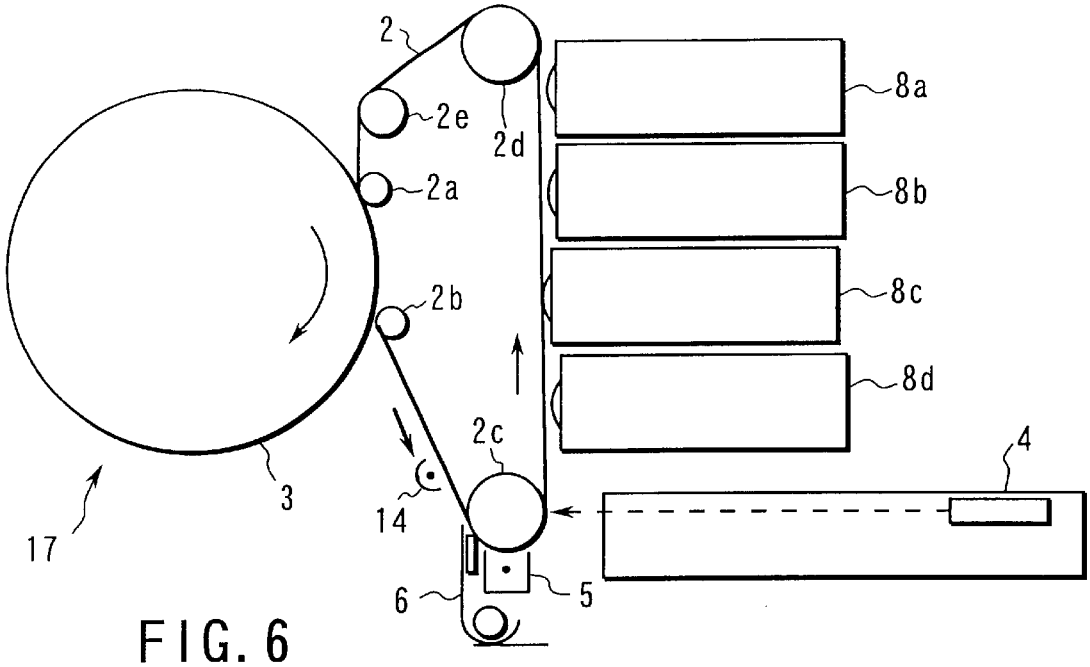
FIG. 6 is a view illustrating an image forming section incorporated in an electrophotographic copy machine according to a third embodiment of the invention.

FIG. 6 shows a third embodiment of the invention.

In this embodiment, elements similar to those in the first embodiment are denoted by corresponding reference numerals and are not described.

In the third embodiment, the developing roller 24 in each developing unit 8*a*–8*d* of the image forming apparatus is brought into contact with the photosensitive belt 2 after the developing units 8*a*–8*d* execute their respective image forming operations.

Figure 7:
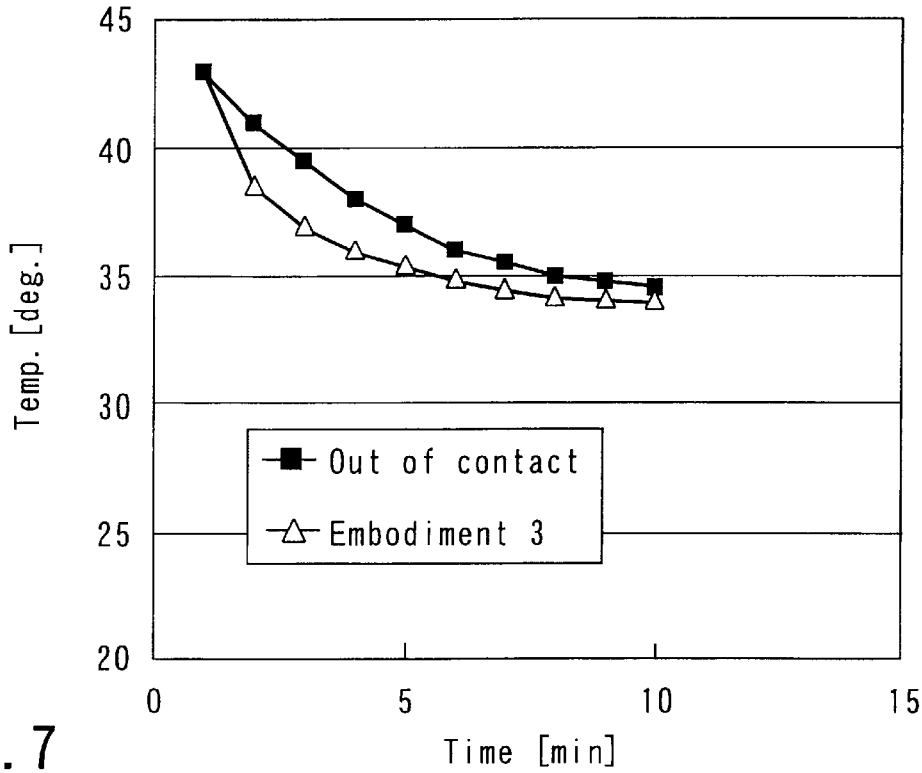
FIG. 7 is a graph indicating respective temperature changes in a developing roller between a case where the developing roller is in contact with a photosensitive belt, and a case where it is out of contact with the photosensitive belt.

FIG. 7 shows the heat dissipation rate of the developing roller 24 of each developing unit 8*a*–8*d* assumed when the developing roller 24 is in contact with the photosensitive belt 2 and when it is out of contact with the photosensitive belt 2, after the image forming operation is finished.

In the third embodiment, since the developing roller 24, the thickness-limiting blade 26 and the photosensitive belt 2 are, each made of a metal as in the first embodiment, they have a high thermal conductivity and dissipation quality. This means that heat generated in each developing unit 8*a*–8*d* and is effectively transmitted to the photosensitive belt 2. Accordingly, accumulation of heat in each developing unit 8*a*–8*d* can be avoided by bringing the developing roller 24 into contact with the photosensitive belt 2 after the image forming operation.

Figure 8:
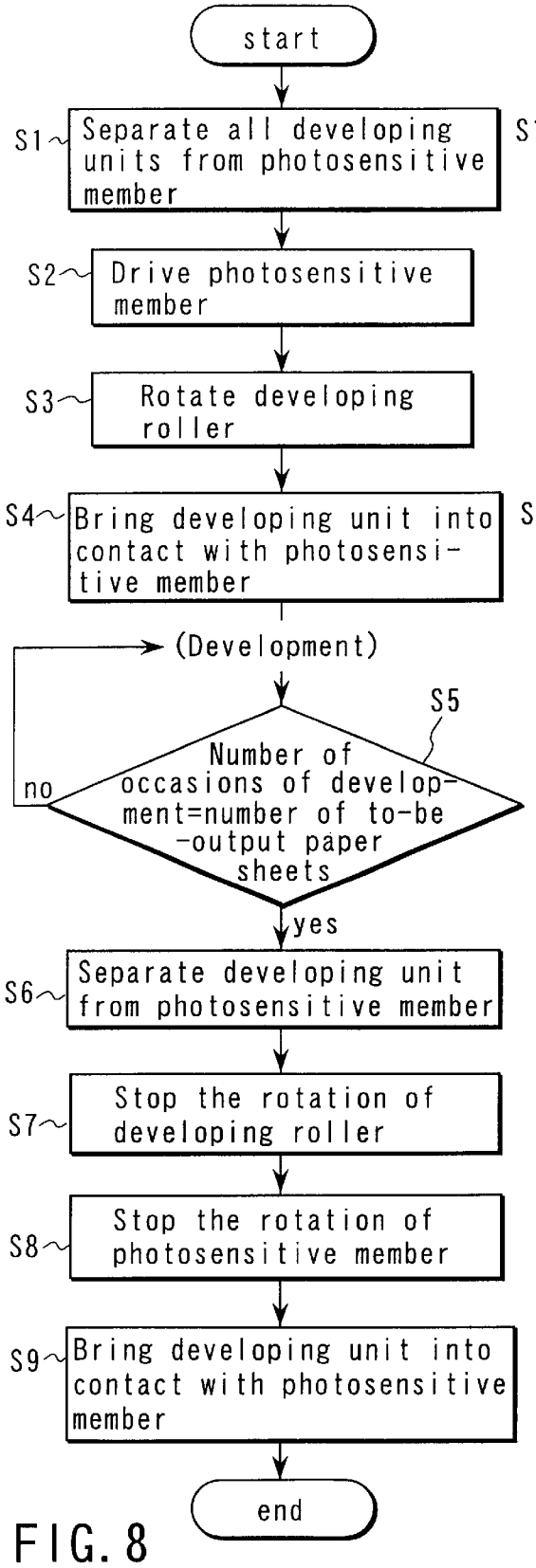
FIG. 8 is a flowchart useful in explaining the operation of bringing the developing roller into and out of contact with the photosensitive belt.
Figure 9:
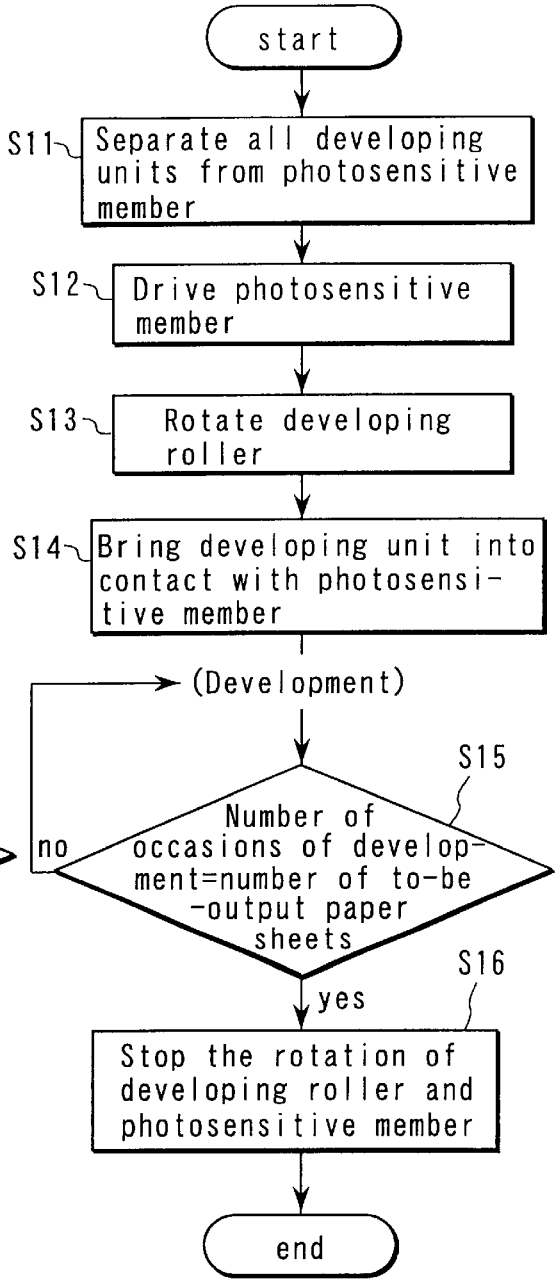
FIG. 9 is a flowchart useful in explaining the operation of bringing the developing roller into and out of contact with the photosensitive belt.

FIGS. 8 and 9 are flowcharts useful in explaining the operation of separating the developing roller 24 of each developing unit 8*a*–8*d* from the photosensitive belt 2 and bringing it into contact therewith, executed after the image forming apparatus outputs monochrome images.

Specifically, FIG. 8 shows a case where all the developing units are temporarily separated from the photosensitive belt 2 after the development operation is finished, and again brought into contact after the photosensitive belt 2 is completely stopped, i.e. after secondary transfer of images onto a paper sheet is finished.

FIG. 9 shows a case where the developing unit 8*d* and the photosensitive belt 2 are kept in contact with each other even after the development operation is finished, and they are simultaneously stopped after secondary transfer of images is finished.

The flowchart of FIG. 8 will now be described.

First, all the developing units 8*a*–8*d* are separated from the photosensitive belt 2 (step S1). Subsequently, the photosensitive belt 2 is driven (step S2). Then, the surface of the photosensitive belt 2 is charged and exposed, thereby forming an electrostatic latent image thereon (this process is not illustrated in the flowchart). Thereafter, the developing roller 24 of the developing unit 8*d* is rotated (step S3), and brought into contact with the photosensitive belt 2 while it is being rotated (step S4), thereby performing development. After that, it is determined whether or not the number of occasions of development is equal to the number of to-be-output paper sheets (step S5). If the number of occasions of development reaches the number of to-be-output paper sheets, the developing unit 8*d* is temporarily separated from the photosensitive belt 2 (step S6), and the rotation of the developing roller 24 of the developing unit 8*d* is stopped (step S7). After stopping the photosensitive belt 2 (step S8), the developing unit 8*d* is again brought into contact with the photosensitive belt 2 (step S9), thereby preventing heat from accumulating in the developing unit 8*d*.

The flowchart of FIG. 9 will be described.

First, all the developing units 8*a*–8*d* are separated from the photosensitive belt 2 (step S11). Subsequently, the photosensitive belt 2 is driven (step S12). Then, the surface of the photosensitive belt 2 is charged and exposed, thereby forming an electrostatic latent image thereon (this process is not illustrated in the flowchart). Thereafter, the developing roller 24 of the developing unit 8*d* is rotated (step S13), and brought into contact with the photosensitive belt 2 while it is being rotated (step S14), thereby performing development. After that, it is determined whether or not the number of occasions of development is equal to the number of to-be-output paper sheets (step S15). If they are not equal, the charging, exposing and developing operations are repeated. If the number of occasions of development reaches the number of to-be-output paper sheets, the developing unit 8*d* and the photosensitive belt 2 are stopped (step S16).

The process shown in FIG. 8 is disadvantageous compared with that of FIG. 9 in that the number of operations of bringing the developing roller 24 into and out of contact with the photosensitive belt 2 is larger in the former than in the latter. However, in the process of FIG. 8, the rotation of the developing roller 24 can be stopped when separating the roller from the photosensitive belt 2, thereby stopping the generation of heat. In this point, the process of FIG. 8 is more advantageous than the process of FIG. 9.

In the process of FIG. 9, only when the rotation of the developing roller 24 is stopped with the photosensitive belt 2 kept driven, or vice versa, immediately after the development process, the surface of the photosensitive belt 2 is degraded because of friction between itself and the developing roller 24. To avoid this, it is preferable that they are simultaneously stopped.

In the embodiment, since the monochrome image output speed is four times the color image output speed, the amount of heat generated in the developing unit 8*d* is greater in the case of outputting monochrome images than in the case of outputting color images.

In light of this, when continuously printing monochrome images, it is desirable that at least the developing unit 8*d* for black toner should be brought into contact with the photosensitive belt 2 after the image forming process. On the other hand, when printing color images, only the developing unit 8*d* for black toner or all developing units may be brought into contact with the photosensitive belt 2 after the image forming process.

Figure 10:
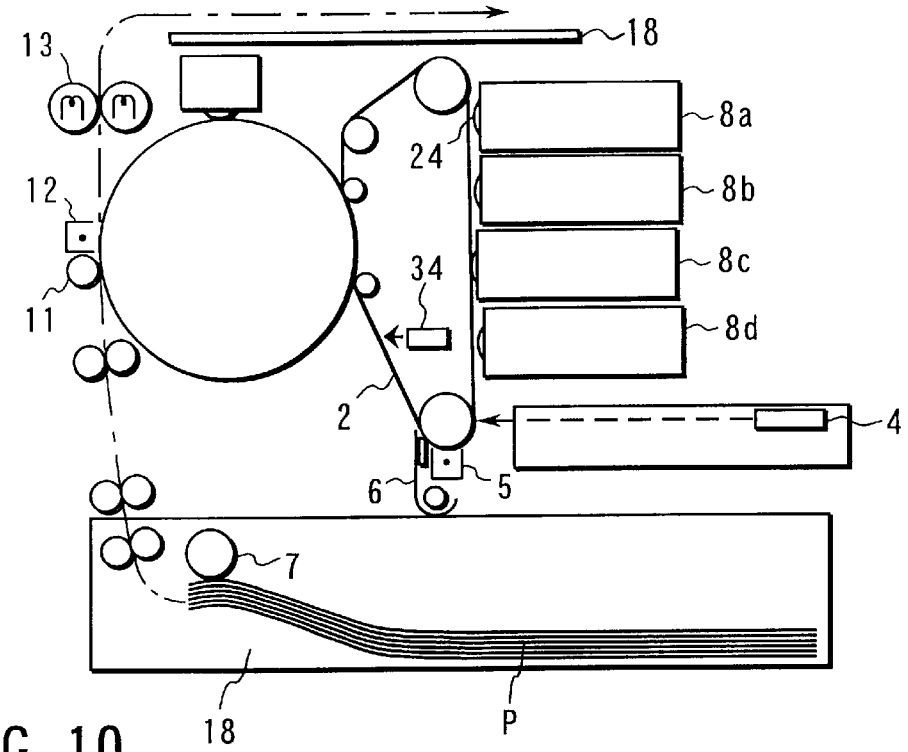
FIG. 10 is a view illustrating an electrophotographic copy machine according to a fourth embodiment of the invention.

FIG. 10 shows an image forming apparatus according to a fourth embodiment of the invention. In this embodiment, elements similar to those in the above-described embodiments are denoted by corresponding reference numerals and are not described.

In the fourth embodiment, a cooling fan (cooling unit) 34 for cooling the photosensitive belt 2 is provided inside the photosensitive belt 2. The cooling fan 34 has a size of 50 mm×50 mm, a thickness of 10 mm, and a maximum airflow of 0.27 $m^3$/mm.

In this embodiment, since the photosensitive belt 2, the developing roller 24 and the thickness-limiting blade 26 are each made of a metal as in the first embodiment, they have a high thermal conductivity and dissipation quality. This means that heat generated in each developing unit 8*a*–8*d* is effectively transmitted to the photosensitive belt 2.

Moreover, the cooling fan 34 for cooling the photosensitive belt 2 further enhances the effect of absorbing heat generated from each developing unit 8*a*–8*d*. This structure effectively prevents the adhesion of toner to the developing roller 24 and/or the thickness-limiting blade 26.

Figure 11:
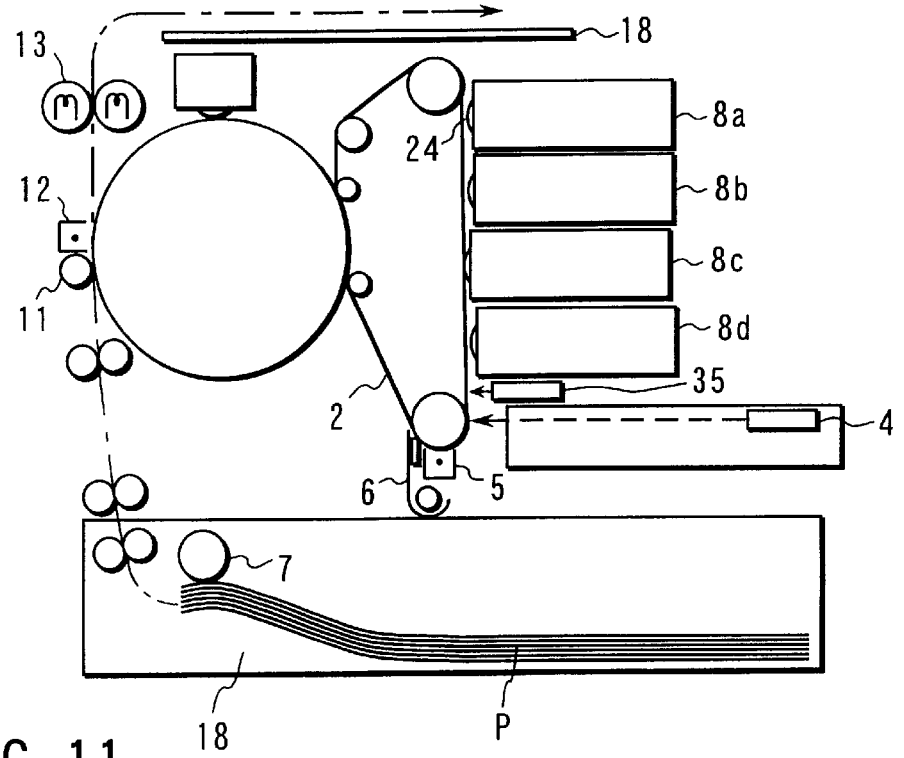
FIG. 11 is a view illustrating an electrophotographic copy machine according to a fifth embodiment of the invention.

FIG. 11 illustrates an image forming apparatus according to a fifth embodiment of the invention. In this embodiment, elements similar to those in the above-described embodiments are denoted by corresponding reference numerals and are not described.

In the fifth embodiment, a cooling fan 35 is provided below the developing unit 8*d* for applying cooling air to the outer surface of the photosensitive belt 2 to cool it.

The fifth embodiment can provide the same advantage as the fourth embodiment.

As described above, in the image forming apparatus of the invention, since the developing roller 24, the thickness-limiting blade 26 and the base material 2*a* of the photosensitive belt 2 are each made of a metal, frictional heat generated at the contact portion between the developing roller 24 and the thickness-limiting blade 26 can be effectively transmitted to the photosensitive belt 2 and thus dissipated.

Accordingly, an increase in the temperature of each developing unit can be prevented, thereby preventing the adhesion of toner to the developing roller 24 and/or the thickness-limiting blade 26, and hence enabling good development.

Further, in the case of using the thickness-limiting metal roller 33 as the thickness-limiting member, a higher temperature increase suppressing effect can be obtained, since the heat dissipation area of the roller is larger than that of a blade-type thickness-limiting member.

Also, since the developing roller 24 of each developing unit is brought into contact with the photosensitive belt 2 after the image forming process, the effect of dissipating the heat of each developing unit can be enhanced.

In addition, since the cooling unit 34 or 35 cools the photosensitive belt 2, an increase in the temperature of each developing unit can be more reliably suppressed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image carrier belt for carrying an electrostatic latent image;

a developing roller to be brought into contact with the image carrier belt for supplying a nonmagnetic mono-component developer to the electrostatic latent image carried by the image carrier belt, thereby forming a developer image;

a thickness-limiting member kept in contact with the developing roller for limiting, to a predetermined value, a thickness of the developer provided on the developing roller; and a transfer unit for transferring the developer image, carried by the image carrier belt, onto an image transfer medium, wherein the image carrier belt is composed of a base material and a photosensitive layer formed on the base material, and the base material, the developing roller, and the thickness-limiting member are each made of metal, and the developing roller is brought into contact with the image carrier belt after a development process is finished.

2. The image forming apparatus according to claim 1, wherein the developing roller is made of a metal selected from the group consisting of aluminum, stainless steel and brass.

3. The image forming apparatus according to claim 1, wherein the thickness-limiting member is made of a metal selected from the group consisting of stainless steel and phosphor bronze having elasticity.

4. The image forming apparatus according to claim 1, wherein the image carrier belt includes a base material and a photosensitive layer formed on the base material, the base material being formed by electroforming Ni.

5. The image forming apparatus according to claim 1, further comprising a cooling unit for cooling the image carrier belt.

6. The image forming apparatus according to claim 1, further comprising a plurality of developing rollers having the same structure as the first-mentioned developing roller, the plurality of developing rollers supplying respective non-magnetic mono-component developers of different colors to the electrostatic latent image carried by the image carrier belt, thereby forming a color developer image.

* * * * *